US008591291B2

(12) United States Patent
Eklund

(10) Patent No.: US 8,591,291 B2
(45) Date of Patent: Nov. 26, 2013

(54) APPARATUS AND GRINDING BLOCK FOR THE TREATMENT OF AN EDGE OR A CUTTING EDGE

(76) Inventor: Tore Eklund, Motala (SE)

( * ) Notice: Subject to any disclaimer, the term of this patent is extended or adjusted under 35 U.S.C. 154(b) by 417 days.

(21) Appl. No.: 12/990,703

(22) PCT Filed: Apr. 20, 2009

(86) PCT No.: PCT/SE2009/050404

§ 371 (c)(1),
(2), (4) Date: Nov. 2, 2010

(87) PCT Pub. No.: WO2009/134193

PCT Pub. Date: Nov. 5, 2009

(65) Prior Publication Data

US 2011/0053473 A1 Mar. 3, 2011

(30) Foreign Application Priority Data

May 2, 2008 (SE) ..... 0800986

(51) Int. Cl.
*B24B 3/54* (2006.01)

(52) U.S. Cl.
USPC ..... 451/162; 451/349; 451/486

(58) Field of Classification Search
USPC ..... 451/349, 162, 164, 166, 45, 321, 486; 76/82, 86, 88
See application file for complete search history.

(56) References Cited

U.S. PATENT DOCUMENTS 1,365,161 A * 1/1921 Eisenhauer ..... 451/486
2,024,860 A * 12/1935 Hobart et al. ..... 451/163
2,200,614 A 5/1940 Booth et al.
2,241,412 A * 5/1941 Meade et al. ..... 451/486
2,249,218 A 7/1941 Meade et al.
2,398,711 A 4/1946 Lambert
2,795,156 A * 6/1957 Murchison ..... 76/86
5,005,319 A * 4/1991 Friel ..... 451/163
2008/0041190 A1 2/2008 Dassaud et al.

FOREIGN PATENT DOCUMENTS

DE 3515934 A1 11/1986

OTHER PUBLICATIONS

International Search Report, dated Jul. 8, 2009, from corresponding PCT application.

* cited by examiner

*Primary Examiner* — Robert Rose
(74) *Attorney, Agent, or Firm* — Young & Thompson

(57) ABSTRACT

A grinding apparatus includes at least two oppositely arranged series of surfaces in slanting relative orientation and alternately overlapping each other, forming this way a groove into which an edge or cutting edge is insertable for polishing by the surfaces. The surfaces of each series of surfaces are arranged in a common plane forming a side in a respective block, the blocks arranged in a holder by which each block is spring biased towards the opposite block, the blocks operated in reciprocating movement transversely to the longitudinal direction of the edge/cutting edge while the surfaces contact opposite sides of the edge/cutting edge under spring action. A grinding block utilized in the grinding apparatus includes a series of individual surfaces arranged in a common plane forming one side of a block divided into sections, which are separated through intermediate recesses into which corresponding sections of an oppositely positioned block intermesh in a toothed engagement while forming a groove between the surfaces.

13 Claims, 2 Drawing Sheets

Figure 1:
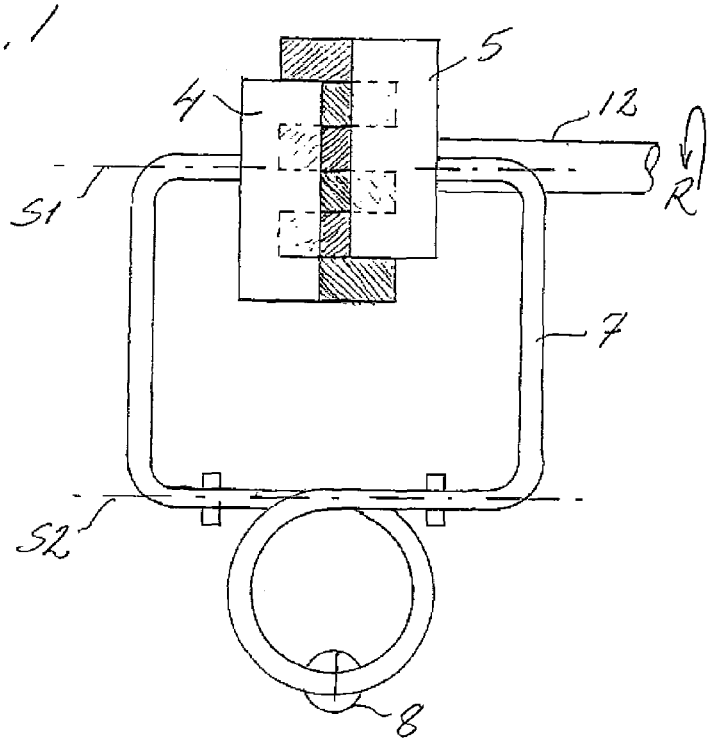

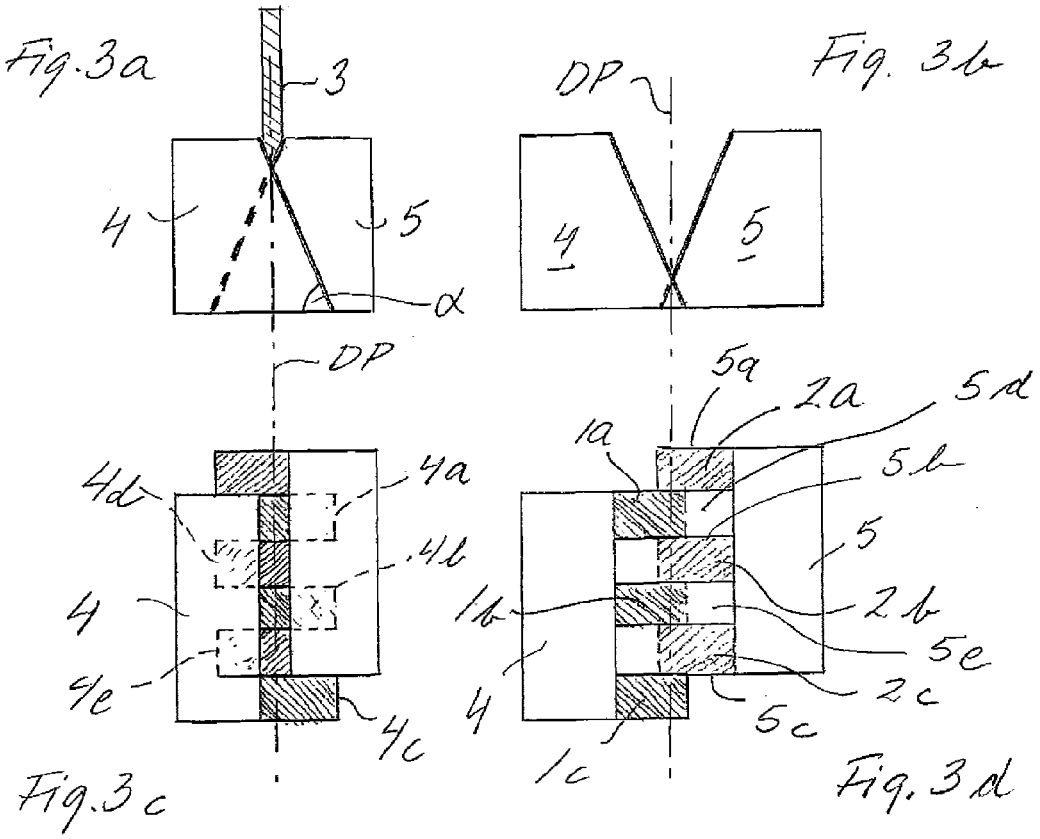
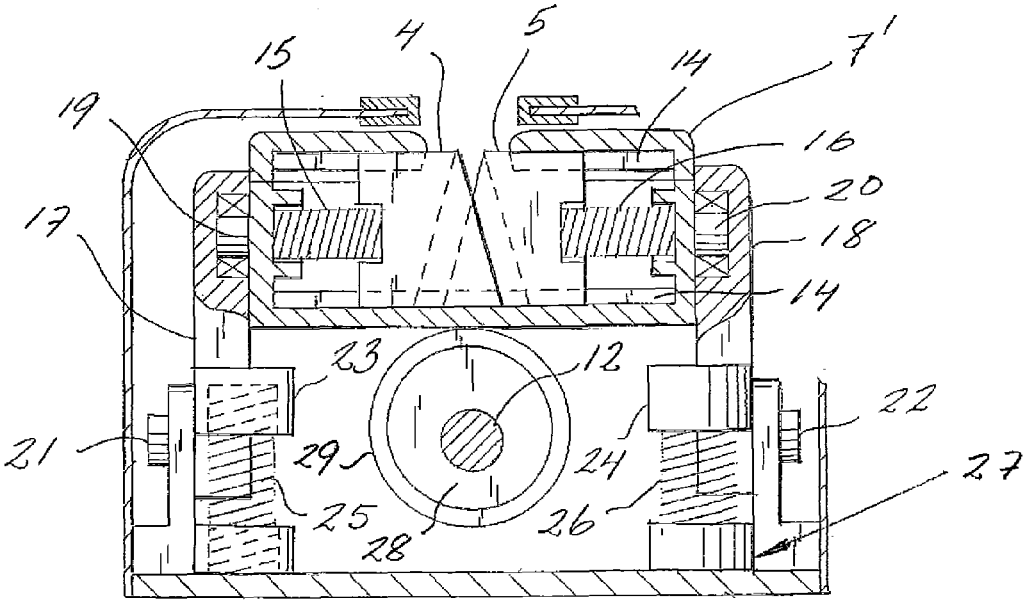
Fig. 4

APPARATUS AND GRINDING BLOCK FOR THE TREATMENT OF AN EDGE OR A CUTTING EDGE

TECHNICAL FIELD OF THE INVENTION

The invention pertains to an apparatus for the treatment of a cutting edge, such as a knife's edge, or the edge of a sheet-formed material, and relates more specifically to an apparatus of the type comprising at least two series of mutually slanting and oppositely arranged surfaces that alternately overlap each other this way forming a groove in which an edge or cutting edge is insertable for treatment by said surfaces. The invention also relates to a grinding block designed for the purpose.

BACKGROUND AND PRIOR ART

In addition to conventional grinding stones, grinding devices for knives and other cutting tools can be separated into two main groups, one of which refers to devices having stationary grinding means requiring that the edge is manually moved forth and back for grinding, and the other main group comprising motor driven grinding means which are driven to move relative to the edge.

The later group is dominated by devices wherein upon grinding the edge has an essentially tangential orientation with respect to a rotating grinding means. As an example on the latter type of devices, reference can be made to the German publication DE-A1-100 44 614. A characteristic feature in these grinding devices is that the polishing direction essentially follows the length direction of the edge, which is not always optimal.

SUMMARY OF THE INVENTION

It is therefore an object of the invention to provide a grinding apparatus which provides an optimal polishing direction transversely to the longitudinal extension of an edge or cutting edge, and which can polish both sides of the edge simultaneously, when appropriate.

Another object of the invention is to provide a grinding apparatus by which it can be ensured that a one-sided or two-sided edge on each occasion can be formed to have the same desired and correct angle.

An additional object of the invention is to provide a grinding block which is designed for an optimal polishing direction transversely to the longitudinal extension of an edge, and which ensures that the edge on each occasion can be formed to have a correct angle.

One or several of these objects are met in a grinding apparatus of the type mentioned by way of introduction, wherein the surfaces in each series of surfaces are arranged in a common plane forming one side of a grinding block, respectively, the blocks being seated in a holder by which each block is spring biased towards the opposite block, the blocks being driven in reciprocating movement transversely to the longitudinal extension of the edge, while the surfaces are resiliently pressed against the mutually opposite sides of the edge/cutting edge.

The series of surfaces is preferably arranged on sections of the subject block, said sections being separated by recesses wherein corresponding sections of the opposite block intermesh in a toothed engagement.

Preferably, material removing surfaces are integrally formed in the block sections, however, the sections of a block can in the alternative be coated with a material removing layer.

It is preferred that the blocks are spring mounted in the holder in the direction of the reciprocating movement.

The reciprocating movement is preferably generated by means of a shaft which is driven in rotation, and a motion conversion means that is caused to rotate with the shaft and arranged to transform the rotary motion of the shaft into a linear, reciprocating movement of the blocks. This motion transferring means may be realized as a disc that is eccentrically supported on the shaft, wherein a wear ring that is supported about the periphery of the disc for free rotation thereabout is arranged to generate the reciprocating movement of the blocks and grinding surfaces.

Alternatively, the motion transferring means may be realized as a disc that is centrally supported on the shaft and having a cam with cam points projecting from the periphery of the disc. Advantageously, the points of the cam may have a smaller angle of inclination as seen in the rotational direction of the disc and in relation thereto a steep angle of inclination as seen in the opposite direction.

Alternatively, the motion transferring means may be realized as an irregularity formed on the shaft exterior, such as a radial projection or a curved axial portion of the shaft.

The blocks are preferably spring biased away from the motion transferring means so as to be brought in motion transferring contact with the motion transferring means upon overcoming of the biasing force.

In addition, the blocks may advantageously be arranged to pivot about a first axis that has a transverse orientation with respect to said groove. Likewise, the holder itself can be pivotally arranged about a second axis that is oriented transversally to the groove.

The third object is briefly met in a grinding means comprising cooperating grinding blocks, each of which includes a series of individual surfaces supported in a common plane and on sections of the block, wherein the sections of the block are separated through intermediate recesses wherein corresponding sections of an opposite block are insertable in a toothed engagement.

Embodiments of the grinding apparatus and the grinding block are more closely disclosed hereinafter in the description and in the appended claims.

SHORT DESCRIPTION OF THE DRAWINGS

Figure 2:
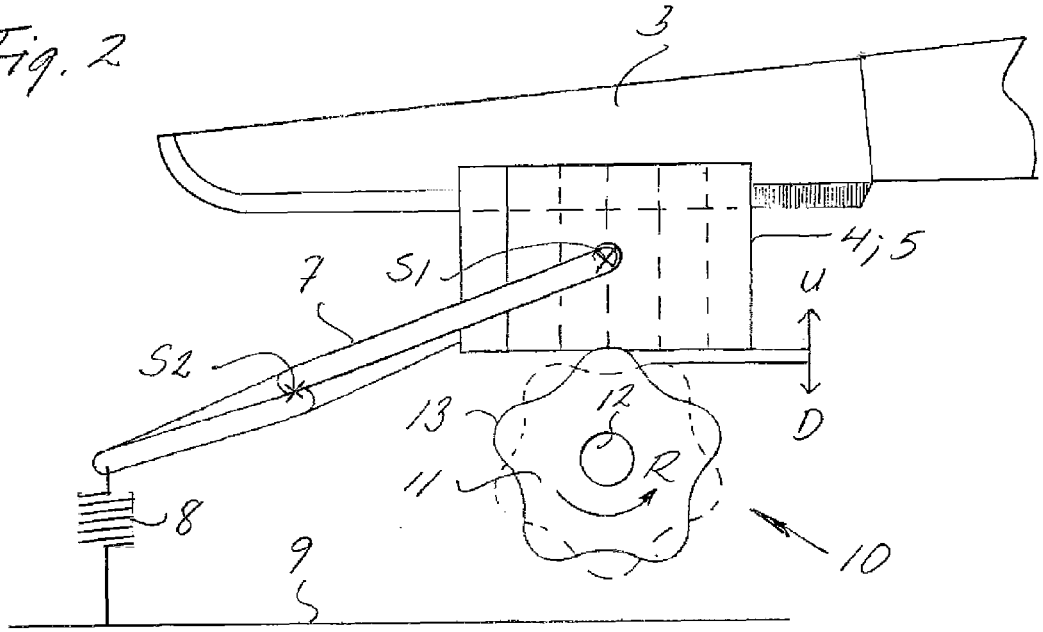

The invention is more closely explained below with reference made to the appended drawings, wherein FIG. 1 schematically shows in a top view the principal structure of a grinding apparatus according to the invention;

FIG. 2 schematically shows the apparatus of FIG. 1 in an elevation view;

FIGS. 3*a*-3*b* are end views, respectively, showing a grinding means incorporated in the apparatus;

FIGS. 3*c*-3*d* show the grinding means from above;

FIG. 4 shows a partially sectioned end view of one embodiment of the grinding apparatus.

DETAILED DESCRIPTION OF THE INVENTION

In the following description, the invention will be explained as applied in a grinding apparatus arranged for sharpening a knife's cutting edge. It should however be understood that the apparatus also can be arranged for shaping or sharpening an edge of other types of cutting tools than knives. It should also be understood that the arrangement can also be adapted to other kinds of treatment besides grinding. For that reason, grinding shall in this context be understood to encompass honing, polishing and other appropriate mechanical processing aiming for shaping or for reshaping an edge.

In this connection it should be noted that the apparatus can also be used in other kind of treatment besides sharpening of cutting edges, such as for chamfering or degrading the edge of a metal plate or a sheet of other material than metal. In the following description and in appended claims, the expression "edge" shall therefore be understood as encompassing both single sided and double sided cutting edges of knives and other cutting or chopping tools, as well as an edge of a sheet-shaped material besides the cutting and chopping tools. Albeit the invention is described below in its application in a grinding apparatus arranged for sharpening of a knife's edge this is not to be understood as limiting the invention to this use and embodiment.

Accordingly, the grinding apparatus comprises mechanically processing grinding means in contact with opposite sides of the edge and which are driven for movement relative to the knife's edge while polishing the edge. With reference to FIGS. 3*a*-3*d*, the grinding means comprises a first series of surfaces 1*a*-1*c* which are oppositely arranged with respect to a second series of surfaces 2*a*-2*c*. Said surfaces are arranged at a slanting angle relative to each other and in overlapping relation, this way forming a groove in which a knife's blade 3 is insertable for polishing the knife's edge. The first series of surfaces 1*a*-1*c* are arranged in a common plane forming one side included in a first block 4, and the surfaces 2*a*-2*c* of the second series are likewise arranged in a common plane forming one side included in a second block 5. Naturally, more than three surfaces can be arranged on the blocks 4, 5, and the blocks need not have the same number of surfaces. It is also conceivable to arrange more than two series of surfaces which are arranged and apportioned to a larger number of blocks than two, and oppositely positioned in pairs.

The subject side of the blocks 4 and 5 are for the purpose arranged to extend at a slanting angle between a bottom plane and a top plane of each block. The bottom and top planes may extend in parallel to adjoin under right angles a side-plane which is opposite to the slanting side-plane on which said surfaces 1*a*-1*c*, 2*a*-2*c* are formed. The slanting angle of the slanting sides or planes can be equal in both blocks, and the slanting angle may, as an example, amount to the order of 15-25 degrees as measured at the angle $\alpha$ between the side-plane and the bottom plane. In the illustrated embodiment, the slanting angle of the side-planes are also related to a symmetrically oriented plane of intersection or parting line DP between the blocks, which corresponds to an ideal insertion direction of a knife's blade having a double-sided cutting edge. In the disclosed example, the slanting and overlapping side-planes thus form a symmetrical, V-shaped groove having an intermediate angle of 30 to 50 degrees.

However, it should be understood that the groove that is formed between the oppositely arranged surfaces can alternatively have another profile than the symmetrical V-profile of the illustrated embodiment, and that the surfaces can alternatively be formed with a convex or a concave profile when the groove is seen along the length direction thereof. It is further to be understood that the slanting angle of the surfaces of one block can be different from the slanting angle of the surfaces of the opposite block. For the polishing of a single-sided edge, the surfaces of one block may lack completely a slanting orientation, such that the angle of the groove formed this way is solely determined through the slanting angle of the surfaces in one of the blocks. In all cases it can be ensured that the angle of the edge becomes the same at each occasion, and is defined by the subject angle between the surfaces of the oppositely positioned blocks.

The slanting side-planes of the blocks are separated into sections 4*a*-4*c* and 5*a*-5*c*, respectively, and the shaping surfaces 1*a*-1*c*, 2*a*-2*c* are formed on these sections. The sections are separated through intermediate recesses 4*d*-4*e* and 5*d*-5*e*, respectively, in which recesses the corresponding sections of the opposite block are insertable in a toothed engagement. The clearance is such that the blocks can move freely and without friction relative to each other as the result of a force that is manually applied to a knife's blade which is inserted in the groove, such as illustrated in FIG. 3*b*. Slide bearings formed as thin sheets of low friction material may be arranged on the sides of the recesses/block sections, if appropriate (not illustrated). The blocks 4, 5 can be formed as a singular piece, or may be assembled from a number of sections which are interconnected through intermediately positioned spacers that form the separating recesses between the sections of a block.

Polishing surfaces 1*a*-1*c*, 2*a*-2*c* can be integrally formed in the slanting sections of the block. To this purpose, the surfaces may comprise ridges or teeth that are formed in the surface of a block which is produced from a metal, a hard metal or a composition of metals. The polishing surfaces may alternatively be integrally formed in a block produced from a hard ceramic material. The block sections may alternatively be lined with surfaces in the form of a material removing surface layer as known per se, comprising a ceramic material or diamond particles, e.g. Alternatively, only one block comprises sections having a material removing surface whereas the opposite block has a smooth surface serving as a counter support, which is the case when the blocks are arranged for polishing a single-sided edge, e.g. For reason of simplicity, the subject surfaces will hereinafter be referred to as grinding surfaces, although it is realized that the surfaces may alternatively serve other functions than grinding.

The blocks 4, 5 and associated grinding surfaces are supported in a holder 7, and spring biased towards an intermeshed condition according to FIGS. 3*a*, 3*c* and FIG. 1. The spring bias acting on the blocks 4 and 5 is schematically illustrated in FIGS. 1 and 2 through a holder 7 structured as a springing yoke. Preferably, the blocks 4 and 5 are pivotally supported by the holder 7, and more precisely pivoting about a first axis S1 running at right angles to the longitudinal direction of the groove. This way, the blocks and grinding surfaces can adjust to the orientation of the knife's blade, and the operation of the grinding apparatus is independent from the exact positioning of the knife's blade in the grinding apparatus.

The holder 7 is itself movably supported in the grinding apparatus, and is more precisely spring biased towards a raised home position wherein the grinding apparatus is not under load and at rest. This is schematically illustrated in FIGS. 1 and 2, wherein the holder 7 is arranged pivotally about a second axis S2 which, similar to the axis S1, runs at right angles relative to the longitudinal direction of the groove, i.e. in parallel to the first axis S1, according to the principal solution. The holder 7 and blocks 4, 5 are biased towards the home position by action of a spring member 8 which is arranged to act between the holder 7 and a not further illustrated structural member 9 of the grinding apparatus. On the other hand, FIG. 2 shows the grinding apparatus in operative position wherein the blocks 4, 5 are subjected to a manually applied load from a knife's blade which is inserted into the V-shaped groove, in result of which the grinding means is brought into contact with a motion transferring means 10 as will be more closely explained below.

The grinding means incorporated in the grinding apparatus is associated with a motion transferring means 10 by which the blocks 4 and 5 and their associated grinding surfaces are driven in a reciprocating movement U-D, transversely or substantially at right angles to the longitudinal direction of the knife's edge to be polished. It should be made clear that the motion referred to is a reciprocating movement in the width direction of the knife's blade, and since the knife's blade during grinding usually has a horizontal orientation, it may also for the purpose of description be appropriate to define the movement as an upwards/downwards movement transversely to the longitudinal direction of the edge.

The motion transferring means can include an electromagnetic driver, comprising for example a permanent magnet that is driven by a coil in reciprocating movement that is transferred to the holder 7.

The motion transferring means preferably comprises a member 11 which is arranged to be brought in rotation through a motor driven rotary shaft 12. The motion transferring means may, e.g., be realized as a circular disc which is supported on the shaft in a non-centre position of the disc, or realized as a cam disc supported on the shaft in a central position, or realized as an irregularity formed on the shaft's exterior such as a radial protrusion or a curved portion of the shaft. Alternatively, the motion transferring means may comprise a pivoting link positioned between the shaft and the holder, or any other structure known per se which is effective for conversion of the rotary motion of the shaft into a linear back and forth movement in the holder/grinding means. In the embodiment including a cam disc supported on the shaft, the points 13 of the cam preferably has a rising flank facing the rotational direction R of the cam disc, and in relation thereto a steeper descending flank on the trailing side of the cam point by which different velocities are accomplished in the movement of the grinding means.

One feature of the invention is that the holder, in result of being subjected to a biasing force, brings the grinding means including the blocks and their associated grinding surfaces out of the operative engagement with the motion transferring means 10. Accordingly, the grinding means is not brought into driving contact with the motion transferring means until the biasing force, acting on the holder, is overcome. This feature can be used to shut off the drive shaft's motor between grinding operations, if a circuit breaker is arranged to be actuated upon pressing down the grinding means into its working position. It can also alternatively be used to passivate an unloaded grinding means in connection with a drive shaft that is driven in continuous rotation.

One embodiment of the grinding means is illustrated in the partially sectioned end view of FIG. 4. In this embodiment, the blocks 4 and 5 with the grinding surfaces 1*a*-1*c* and 2*a*-2*c*, respectively, are supported to slide on guides 14 which are formed inside a box-shaped holder 7'. The guides 14 are received in corresponding grooves formed in the parallel top and bottom planes of each block. The oppositely positioned and mutually engaging blocks 4 and 5 are spring biased towards each other by means of spring members 15 and 16, acting between the holder and each block, respectively. The holder 7' is pivotally supported in the upper ends of a couple of suspension struts 17 and 18, and more precisely pivoting about a pivot axis which is represented by the pivots 19 and 20, respectively. The suspension struts are realized as link arms reaching downwards from the pivots 19, 20 at a slanting angle, i.e. behind the drawing plane of FIG. 4, and are in their lower ends pivotally journalled on pivots 21 and 22, respectively. Plane or ball bearings, not illustrated, may be incorporated in the pivots if appropriate. Seats 23 and 24 are formed in the lower sides of the suspension struts. One end of a respective spring member 25 and 26 is received in the corresponding seat, whereas the other end of these spring members is secured in a structural element 27 of the grinding apparatus.

In the illustrated embodiment the motion transferring means is realized as a disc 28 which is non-rotationally secured to a rotary shaft 12'. The disc 28 is connected to the shaft in a non-centre position of the disc. The displacement of the point of connection from the geometric centre of the disc is preferably determined such that the difference between distances from the connection point to the highest and lowest points of the disc amounts to the order of 1-10 mm. A wear ring 29 is supported floating on the periphery of the disc, the wear ring thus permitted free rotation about the disc. The contact between the eccentrically rotating disc 28 and the holder 7' is thus established via the wear ring 29, which may be produced from a synthetic material having low friction coefficient. The arrangement is powered by an electric motor running at a suitable number of revolutions such as 15-30 000 rpm which, in combination with the resilient contact between the grinding blocks/grinding surfaces and the opposite sides of the knife's blade, results in a smooth operation.

In one embodiment adapted for sharpening the cutting edge of a knife or other tool, the grinding apparatus according to the invention is preferably arranged for standing on a worktop. In other applications the grinding apparatus can be arranged as a hand held tool which can be moved forth and back along an edge or cutting edge. The grinding apparatus may also be realized as auxiliary equipment mountable on a tool or tool holder which is powered by electricity or by air.

In one alternative embodiment, the polishing surfaces 1*a*-1*c*, 2*a*-2*c* may have other shapes than the planar shape which is illustrated in the drawings. It should be noted, albeit not being shown in drawings, that these surfaces may be shaped to have convex configuration as viewed in a longitudinal section through the blocks, this way forming in cooperation a groove that is wave-shaped in its longitudinal direction between the oppositely positioned blocks. This alternative embodiment makes possible the grinding of a knife having a wave-shaped cutting edge. It is also conceivable to form the surfaces with an obtuse angle as viewed in the longitudinal section, forming a saw-toothed groove between the opposite blocks.

From the above description it will thus be realized that the invention may be used in several embodiments which differ in detail from the embodiment explained above, without departing from the concept of the invention as this is defined through the appended claims.

The invention claimed is:

1. A grinding apparatus, comprising:

at least two oppositely arranged series of surfaces (1*a*-1*c*; 2*a*-2*c*) in slanting relative orientation and alternately overlapping each other forming a groove into which an edge or cutting edge is insertable for polishing by said series of surfaces, wherein surfaces of each series of surfaces are arranged in a common plane forming a side in a respective block (4; 5), the blocks (4; 5) arranged in a holder (7; 7') by which each block is spring biased towards an opposite block, the blocks operated in reciprocating movement (U-D) transversely to a longitudinal direction of the edge or cutting edge while the surfaces contact opposite sides of the edge or cutting edge under spring action, and wherein the blocks are driven in reciprocating movement by means of a shaft (12) driven in rotation and a motion transferring means (10) rotating with the shaft, said motion transferring means configured to convert a rotation (R) of the shaft into a linear forth and back movement of the blocks.

2. The grinding apparatus according to claim 1, wherein the series of surfaces (1*a*-1*c*; 2*a*-2*c*) are arranged as sections (4*a*-4*c*; 5*a*-5*c*) of the associated block (4; 5), the sections separated through recesses (4*d*-4*e*; 5*d*-5*e*) in which corresponding sections of the opposite block intermesh in a toothed engagement.

3. The grinding apparatus according to claim 1, wherein the blocks (4; 5) are spring mounted in the holder (7; 7') in direction of the reciprocating movement (U-D).

4. The grinding apparatus according to claim 1, wherein the motion transferring means is a disc (28) supported on the shaft in a non-centre position of the disc.

5. The grinding apparatus according to claim 4, wherein the motion transferring means comprises a wear ring (29) arranged to rotate freely about the periphery of the disc supported in the non-centre position.

6. The grinding apparatus according to claim 1, wherein the motion transferring means is a disc (11) supported on the shaft in a central position of the disc and having points (13) of a cam formed in the periphery of the disc.

7. The grinding apparatus according to claim 6, wherein the points (13) of the cam disc rise in the rotational direction (R) of the cam disc, and in relation to the rise descend more steeply on the trailing side of the cam point.

8. The grinding apparatus according to claim 1, wherein the motion transferring means is an irregularity formed on the exterior of the shaft.

9. The grinding apparatus according to claim 1, wherein the blocks (4; 5) are spring biased away from the motion transferring means (10), and brought into contact with the motion transferring means by overcoming the biasing force.

10. The grinding apparatus according to claim 1, wherein the blocks (4; 5) are arranged pivotable about an axis (S1) running transversely to the groove that is formed between the blocks.

11. The grinding apparatus according to claim 1, wherein the holder (7; 7') is arranged pivotable about an axis (S2) running transversely to the groove.

12. The grinding apparatus according to claim 8, wherein the irregularity formed on the exterior of the shaft is a radial projection of the shaft.

13. The grinding apparatus according to claim 8, wherein the irregularity formed on the exterior of the shaft is a curved portion of the shaft.

* * * * *